US005179995A

United States Patent [19]

Limb

[11] Patent Number: 5,179,995

[45] Date of Patent: Jan. 19, 1993

[54] COMBINATION VACUUM ASSIST CENTRIFUGAL CASTING APPARATUS AND METHOD

[76] Inventor: Stanley R. Limb, 1721 E. 7200 South, Salt Lake City, Utah 84121

[21] Appl. No.: 646,806

[22] Filed: Jan. 28, 1991

Related U.S. Application Data

[63] Continuation-in-part of Ser. No. 380,387, Jul. 17, 1989, abandoned.

[51] Int. Cl.[5] ..... B22D 13/00

[52] U.S. Cl. ..... 164/114; 164/286; 164/DIG. 3

[58] Field of Search ..... 164/61, 63, 65, 114, 164/118, 253, 286, 287, 289, 296, 298, DIG. 3

[56] References Cited

U.S. PATENT DOCUMENTS

| | | | |
|---|---|---|---|
| 3,402,755 | 9/1968 | Christian | 164/61 |
| 3,863,702 | 2/1975 | Hallerberg | 164/114 |
| 3,865,173 | 2/1975 | Rohrberg | 164/289 |
| 3,941,181 | 3/1976 | Stoody | 164/114 |
| 4,027,719 | 6/1977 | Strempel | 164/114 |
| 4,134,445 | 1/1979 | Goodrich | 164/289 |
| 4,703,806 | 11/1987 | Lassow | 164/518 |
| 4,726,413 | 2/1988 | Hellebrand | 164/289 |
| 4,781,237 | 11/1988 | Sing | 164/255 |

FOREIGN PATENT DOCUMENTS

| | | | |
|---|---|---|---|
| 133337 | 5/1933 | Fed. Rep. of Germany | 164/289 |

*Primary Examiner*—Richard K. Seidel
*Assistant Examiner*—Rex E. Pelto
*Attorney, Agent, or Firm*—Marcus G. Theodore

[57] ABSTRACT

A centrifugal vacuum assist ambient air casting apparatus and method to fill a casting flask having a mold with a pour opening in communication with the pour opening of a casting crucible filled with molten metal and ceramics comprising: centrifugally spinning the casting flask and casting crucible with their pour openings aligned such that the resulting centrifugal forces empty the contents of the casting crucible into the casting flask, while simultaneously applying a directional vacuum to the casting flask in alignment with the resultant centrifugal forces to evacuate trapped gases from the mold and assist in drawing in the molten metal and ceramics into the mold.

6 Claims, 3 Drawing Sheets

COMBINATION VACUUM ASSIST CENTRIFUGAL CASTING APPARATUS AND METHOD

RELATED APPLICATION

This application is a continuation-in-part application of the originally filed application entitled "Combination Vacuum Assist Centrifugal Casting Method and Apparatus" filed Jul. 17, 1989, Ser. No. 07/380,387 now abandoned.

BACKGROUND OF THE INVENTION

1. Field

This invention relates to metal and ceramic casting methods. Specifically, it relates to a combination vacuum assist centrifugal casting method and apparatus.

2. State of the Art

A number of metal and ceramic casting methods are known. The lost wax replacement casting method involves: 1) making a model of the object to be cast, 2) spruing the model to a wax tree at one or more points to form a path for the molten metal to flow; 3) mixing and pouring the investment into a mold to surrounding the model, 4) burning off the wax model and sprue to form a mold in a casting flask, and 5) and filling the resulting mold with metal.

Generally, the gold, silver, bronze, etc. to be cast is melted directly (either in a centrifugal machine or in a separate pouring crucible) with a hand torch. Another method is to melt the metal in a pouring crucible in a gas or high frequency induction casting furnace, and then pour the metal into the casting flask.

To minimize voids and porosity in the casting caused by trapped gases in the mold, two types of methods for casting metals utilizing the lost wax replacement method were developed: centrifugal casting, and vacuum assist casting.

Centrifugal casting was initially developed by dentists where small casts were required. Centrifugal casting utilizes a centrifuge to hurl molten metal to fill the voids of the pattern mold of a casting flask left after the wax has been burned off. Centrifugal casting apparatus typically have a centrifuge operably associated with a spinning arm on which a casting flask is mounted toward the end of the arm with the opening of the mold held in proximity to the opening of a casting crucible; see Hellebrand et al, U.S. Pat. No. 4,726,413, Zu Der Patentshcrift Nr. 133337; Goodrich et al, U.S. Pat. No. 4,134,445; as examples of centrifugal casting methods.

There are two basic methods for creating the wax model: carving or cutting solid wax into the form, and the building of a model from scratch, or a combination of the two. The model is formed from wax which comes in various sizes, shapes, and textures. Wax may be obtained in wire form, sheets, solid block, preformed and semi-preformed wax. Wax is color coded. This code varies with the manufacturer, so it cannot be depended upon when using wax from various manufacturers. The wax is worked by filing, drilling, cutting, adding and removing, using regular bench tools, plus carving tools that have been borrowed from the dental profession. These dental type tools are warmed over a flame to work the wax. Rings are formed on a mandrel which gives the correct desired size to the model, so the finished ring will be produced in a predetermined size without the problem of sizing later.

The method of attaching the sprue wax to the model at one or more points to form a path for the molten metal to flow without leaving a void in any of the distant parts is known as spruing the model.

The following must be completed before you proceed to mix the invest slurry. The model must be correctly and securely sprued to the appropriate size sprue-base and a clean flask to fit this base must be handy. The model must have also been painted with a surface tension reducer which has had time to air-dry. Other methods, such as Lassow et al., U.S. Pat. No. 4,703,806 utilize a mold facecoat and core coating system for investment casting of reactive metals.

When mixing, the powder is added to water at room temperature, approximately 70–75 degrees. If the water is too cold, it will delay the hardening process. If it is too warm, it will speed up this process. If available, the manufacturer's quantities and ratios for mixing should be followed.

The following table will give general information for the common and most used size flasks:

CAPACITY OF FLASKS

| Flask Size | | Water | | Powder | |
|---|---|---|---|---|---|
| Height (in.) × Diameter (in) | cc. | Ounces Avoir. | | Grams | Ounces Avoir. |
| 1½ × 1¼ | 20 | 7/10 | | 50 | 1¾ |
| 1⅝ × 1¾ | 40 | 1 2/5 | | 100 | 3½ |
| 2⅜ × 2½ | 90 | 3 1/5 | | 225 | 8 |
| 2½ × 3½ | 180 | 6 3/10 | | 450 | 15¾ |

When painting a model, the investment is pushed in front of the brush rather than a dabbing action. This helps prevent trapped air from being caught in the crevices of the model. When pouring investment to surround the model, the investment is poured down the side of the flask rather than on top of the model again to avoid trapping air and causing an imperfect mold.

After the investment has been mixed, the wax model sprued and attached to its base, and the model painted with investment; the flask is then fitted to the base and readied to pour investment. The flask is then filled with investment completely surrounding the wax model.

The next step is to purge the flask of any trapped air. This is done on a vibrator or with the aid of a vacuum machine. Whichever method is used, the flask is left on the unit until escaping air bubbles are no longer visible. The invested flask is then set aside to cure or harden. At this point we are ready for the burnout process.

In this step the encased wax model is put into the kiln to be burned out or vaporized to make room for the pouring of the molten metal. This is generally accomplished by placing the flask into the kiln which has been preheated to 300 degrees. The flask is positioned, sprue side down, using the following time and temperature table when raising the temperature level in each specified stage.

TABLE

BURNOUT STAGES AND TEMPERATURES

| | Flasks up to 2½ in. × 2½ in. | Flasks up to 3½ × 4 in. |
|---|---|---|
| 1st stage | 1 hour at 300 degrees | 1 hour at 300 degrees |
| 2nd stage | 1 hour at 600 degrees | 2 hours at 600 degrees |
| 3rd stage | 1 hour at 1,100 degrees | 2 hours at 1,100 degrees |
| 4th stage | 2 hours at 1,350 degrees | 2–3 hours at 1,350 deg. |
| 5th stage | 1 hour. Reduce to proper casting temperature | 1 hour. Reduce to proper casting temperature |

Temperature not to be raised above 1,375 degrees

The burnout cycle should not be started unless the full process is to be completed. If a partially burned out flask is re-heated, it generally results in cracked investment and a ruined mold. After the prescribed time has elapsed, the flask is allowed to cool until it has reached the listed temperature for the metal to be used. This casting temperature is fairly critical.

| INVESTMENT CASTING TEMPERATURE | |
|---|---|
| Gold | |
| Thin, lacy jewelry articles | 1,050 to 1,100 degrees |
| Thick, heavy jewelry articles | 800 to 900 degrees |
| Sterling silver | 750 to 850 degrees |
| Bronze | 900 to 1000 degrees |
| Brass | 750 to 800 degrees |
| Pewter | The flask should be cooled to room temperature (72 degrees) |

Casting is the final step wherein the molten metal forced or drawn into the mold by one of the two methods-centrifugal or vacuum.

The centrifugal casting method utilizes a centrifugal casting machine to hurl the molten metal into the mold. To operate the centrifuge casting device, the casting crucible is first filled with metal and heated to melt the metal. The centrifuge is then activated to provide a constant force flow to force the metal into the mold.

Smaller production custom designed jewelry is generally cast using a conventional centrifugal arm casting machine powered by a spring driven motor. The conventional centrifugal casting machine has a rotating arm attached to the drive shaft of the motor, forming a first segment having a casting crucible mounted proximate its end; and a second segment with a movable counterbalancing weight attached near the other end to provide for balanced rotation. A good centrifugal machine will have a broken arm, which straightens out when the centrifuge reaches the desired force level so that the molten metal will not slide out the side of the crucible before the rotating arm develops sufficient speed to create a centrifugal force strong enough to force the molten metal directly into the flask. Examples of centrifugal broken-arm spring activated casting machines, Models CG2T, and CG4, produced under the trademark dixon ®; and Model CA-1032 produced under the trademark VIGOR ®; and Model Nos. 164–200 and 164–210 produced by Kerr. An example of an electrically driven motorized centrifugal caster is Model No. 160–040 produced by Rey.

The casting crucible has an open top with a pour spout aligned to pour molten metal into a casting flask having its pour opening in alignment with the axial length of the first arm.

The centrifugal casting machine must be balanced before each cast. This balancing step must be carried out before each burnout since there is little time from burnout to cast. To balance a centrifugal casting machine, the bent portion of the casting arm is straightened and wedged with a paper match. The invested flask, shield, crucible are set into place aligning the pour opening of the crucible with the opening of the mold. The metal that is to be used for the casting is placed into the crucible, and the center pivot thumb screw is loosened to let the arm balance at this point. Using the counterbalancing weight on the opposite end of the arm, the arm is brought into balance and secured to the shaft by tightening the thumb screw.

To commence centrifugal casting, the centrifuge spring drive motor is wound by turning the machine arm clockwise three or four full turns. When the required number of turns is reached, the arm is locked in place. The casting crucible is loaded with the premeasured amount of casting metal. The metal is then heated to the melting point with a gas torch. At the point where the casting metal becomes fluid and rolling, the hot burned out flask is removed from the kiln and mounted ahead of the crucible flush to the flask. Again the metal is heated, playing the flame until the metal melts and balls and rolls once more. A flux, such as borax, is generally sprinkled with the melting metal during heating to minimize oxidation. Strempel, U.S. Pat. No. 4,027 utilizes an inert gas delivery system associated with the centrifugal casting arm to cover the molten metal to prevent oxidation. Christian, U.S. Pat. No. 3,402,755 utilizes a thin metalizing layer to cover the mold before casting to prevent oxidation. At the point where the molten metal rolls freely, the centrifugal arm is released and spun by the drive motor.

The arm is allowed to stop, and the flask removed and submerged into a cool bucket of water. The investment will break up from the rapid temperature change and the casting will be released. In some cases a little push is needed.

After the metal cools, the investment is broken away from the finished casting. Small adhering pieces are then brushed away with water, or jetted away under a steam jet cleaner. To remove stubborn investment, a sand blaster can also be used.

To remove oxides and adhering glazed investment, the casting may be pickled with sulfuric acid or other pickling agents.

Although this centrifugal casting method is a significant improvement from a gravity flow pour method (wherein molten metal is simply poured into the mold), gas pockets can form within the mold so that its fine features are lost. The trapped gas in the mold can result in turbulence in the metal, as well as oxidation of the metal, causing porosity in the cast metal product.

To avoid the problem of trapped gas, vacuum assist casting was developed. Typically, vacuum assist casting first involves investing the casting flask mold under vacuum or vibration in a similar manner outlined above for centrifugal casting to eliminate air bubbles in the investment. The casting flask is then mounted on a vacuum table which creates a vacuum at one end of the flask to draw air and gases from the mold. Molten metal is then poured into the casting flask to gravity fill the mold. Although the gas pockets are removed, the molten metal is not forced into the mold by a constant flow force in excess of gravity. Consequently the mold may not properly be filled. Examples of combination investment and vacuum assist casting devices are: Model CCS-1752 Cal-Cast Invest and Cast; Model CCS-3000 Maxi-Vac Casting Unit; Model HY705-035 Rio Grande Vacuum Investing and Casting Machine; and Model 17-016 Pro-Craft TM Vacuum Machine for Investing and Casting.

One present solution to eliminate these problems is to employ a centrifuge entirely encased within a vacuum; see Sing, U.S. Pat. No. 4,781,237 as an example of a rotary casting apparatus employing a vacuum. However, these apparatus require expensive induction heating elements, and vacuum handling equipment operating enclosed entirely within a vacuum. This specialized equipment is not suitable for smaller production operations, which cannot carry the cost of the equipment. Nor do these devices apply a vacuum in a manner to assist the centrifugal force in forcing molten metals into the mold. Consequently, although these methods generally result in quality castings, porosity can develop.

Cited for general interest in Rohrberg, U.S. Pat. No. 3,865,173, which discloses a continuous gas welding system Applicant's method and apparatus described below provides an inexpensive combination centrifugally fed vacuum assist method combining the advantages of both methods.

SUMMARY OF THE INVENTION

Applicant's combination centrifugal vacuum assist method to fill the casting flask of an adapted conventional centrifugal arm casting apparatus with molten metal or ceramic material under ambient air conditions, comprises: 1) centrifugally spinning a casting flask with an aligned pour opening of a mold in communication with the mold opening of a casting flask such that the resulting centrifugal forces cause the molten metal to fill the casting flask, and 2) simultaneously, applying a directional vacuum to the casting flask in alignment with the centrifugal forces to evacuate trapped gases and assist in drawing in molten metal into the mold.

Where the molten metal is reactive to air, simple addition of flux to the molten metal minimizes tarnishing caused by the torch heating the metal. Inert gas covering the molten metal is therefore not necessary. Consequently, it is not necessary cast under inert gas or vacuum conditions to prevent the gas from becoming trapped, causing porosity.

It has also been found that the burn-out time for the removal of the wax from the casting flask is less with applicant's combination centrifuge/vacuum cast method, because the vacuum more readily removes the smaller by-products from the mold, than using heat alone to drive off these by-products. As a consequence, a cleaner, better filled casting is made via applicant's combined vacuum assist centrifugal casting method. This results in a more solid cast with fewer pores which have to be filled. It also lessens the polishing and cleaning time of the finished product, because tarnishing, and carbonization are avoided. A truer reproduction of the mold features thus results.

Applicant's vacuum assist centrifugal casting apparatus adapts a conventional centrifugal casting machine having an electric or spring driven motor with a rotating vacuum valve, a vacuum heat pad, and interconnecting tubes connecting the valve, vacuum heat pad, and their components to a conventional vacuum system.

The conventional centrifugal casting machine also has attached to the drive shaft of the motor, a rotating arm with a first arm segment (the short arm) having a casting crucible mount on which the casting crucible is mounted proximate the end. A second arm segment has a movable counterbalancing weight attached near the other end to provide the entire apparatus with a more balanced rotation. Instead of a thumb screw to secure the arm to the drive shaft, applicant's invention has a rotating vacuum valve described below.

The casting crucible has an open top with a pour spout aligned to pour molten metal into a casting flask having an opening in alignment with the axial length of the first arm segment.

The mount has a butt plate with an evacuation port against which the casting flask is secured. To form a seal between the butt plate and casting flask, a fluoro- carbon rubber high heat resistant vacuum heat insulation pad with a hole in line with the exhaust port of the butt plate is included to forms a seal between the bottom of the casting crucible and the butt plate.

Where a vacuum chamber is utilized, it is hinged to the mount to be tipped to aid in the insertion and removal of the casting flask. This is particularly necessary when the tight fitting vacuum chamber is employed with a casting flask as described below.

A flexible vacuum tube connects the exhaust port of the butt plate with a rotating vacuum valve. The rotating vacuum valve secures the rotating arm to the drive shaft to deliver the desired vacuum, while preventing the tubes from tangling. The rotating vacuum valve is also connected to a conventional vacuum source, such as a vacuum pump system, to provide the desired vacuum to the exhaust port. To assist the user in this regard, a vacuum gauge may be associated with the vacuum pump system to display the amount of vacuum applied.

To operate the vacuum assist centrifugal casting kit, a casting crucible is prepared as described above by making a wax sculpture of the jewelry piece and investing it into a semi-porous investment media, such as Ultra Vest TM produced by Ransom and Randolph. In addition, a wax mesh or bars may be placed within the investment media to create additional collection and transfer passages through which gases passing through the investment media may be collected and withdrawn. The casting crucible is then heated to burn off the wax, leaving a mold of the sculpture piece, and the transfer passages. This casting crucible is then aligned on its side on the mount near the end of the short arm of the centrifuge next to the casting crucible so that the pour spout opening of the casting crucible is in communication with the opening of the mold.

The bottom of the casting crucible is sealed in position for casting by the vacuum heat pad and butt plate held normal the axial length of the arm. The butt plate has an exhaust port connected via a tube to the rotating vacuum valve associated with a vacuum system. This sealed vacuum exhaust port directs the vacuum through the bottom of the casting flask to evacuate gases entering the transfer passages in a direction in line with the centrifugal forces generated by the centrifuge.

Before casting, the vacuum system is activated to remove air from the voids in the mold via the transfer passages. Metal is then placed in the casting crucible and heated with a blow torch, open flame, or the like, until molten. The drive motor of the centrifuge is then activated to centrifugally transfer the molten metal under constant force and vacuum into the mold in the casting flask. The metal is thus simultaneously drawn and forced into the mold, completely filling all segments of the mold, while any remaining unburned hydrocarbons are removed to prevent tarnishing.

Because the hydrocarbons are removed by the vacuum, applicant's method significantly reduces burn-out time for the wax removal. It thus is not necessary to completely drive off the gases through continued heating. In one particular test, applicant was able to reduce the burn-out time required for a large ring from 8–12 hours to approximately 3 ½ hours, without suffering any porosity or tarnishing problems.

Where it is preferable to have more surface area for evacuation, a vacuum chamber may be included to enclose the entire casting crucible except its mold opening. The casting crucible has a large number of evacuation passages added to the casting flask as described above to increase the surface evacuation area. The casting flask is then sealed within the vacuum chamber and secured therein with a collar. An evacuation port in the vacuum chamber is then associated with the vacuum pump to collect and remove all gases escaping the crucible, regardless of the direction of evacuation through the evacuation passages. This enclosed casting crucible is then evacuated and cast in a similar method to that described above. Even though a directional vacuum is not fully applied via this embodiment, the pressure drop of the vacuum across the mold beyond the mold opening coupled with the centrifugal force and partial directional vacuum generally provides an adequate cast.

DESCRIPTION OF THE ILLUSTRATED EMBODIMENTS

Figure 1:
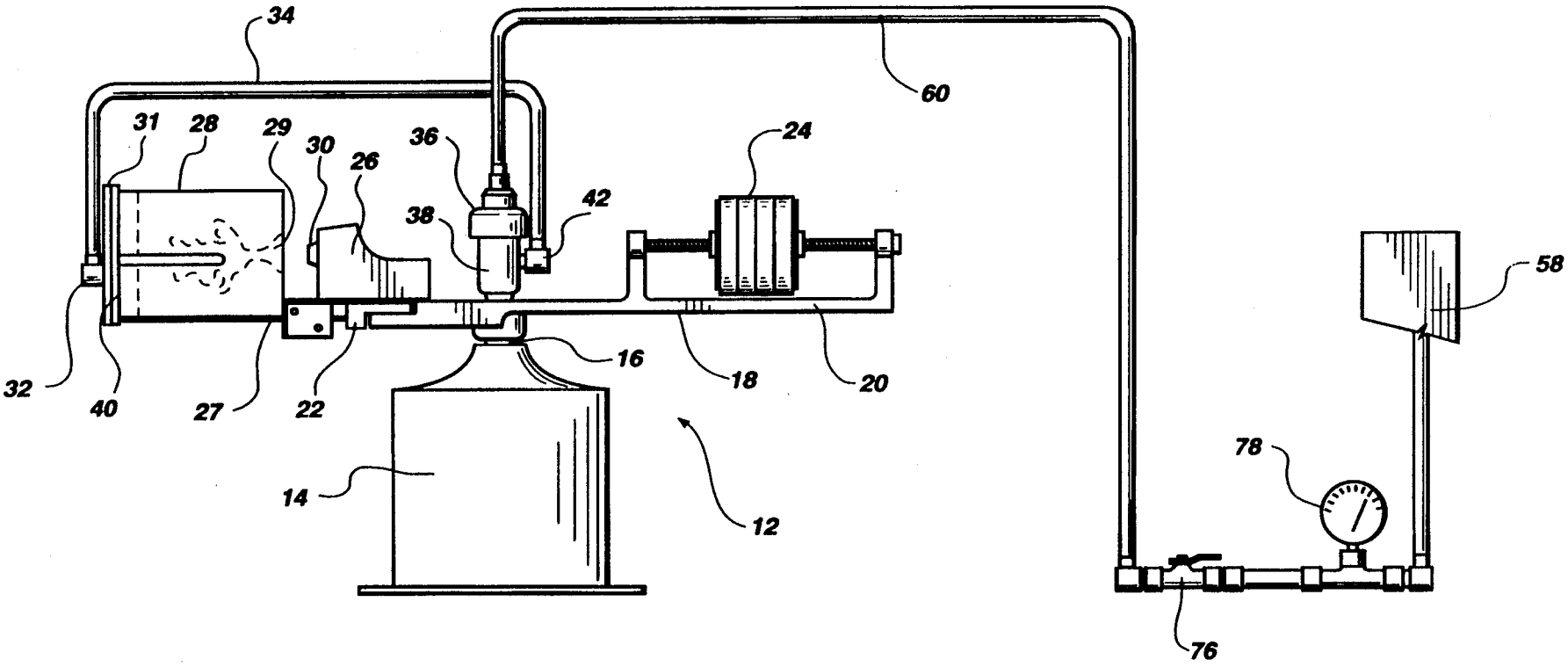
FIG. 1 illustrates a perspective view of a preferred embodiment of the casting apparatus.

FIG. 1 is a perspective view of one preferred embodiment of applicant's invention adapted for use as a centrifugal force casting mechanism 12. The casting mechanism 12 has a spring driven drive motor 14 whose shaft 16 is centrally attached to a rotating arm 18 having two arm segments 20,22. A counterbalancing weight 24 is attached on one arm segment 20, and a casting crucible 26 is attached proximate the end of the other arm segment 22. Between the end of the arm segment 22 and the casting crucible 26 is a mount 27 adapted to hold a casting flask 28 on its side with its mold opening 29 of the casting flask 28 in alignment with the pour spout 30 of the casting crucible 26. To align the casting flask 28 mold opening 29, various shims and mounts (not shown) may be used to raise or lower the casting flask.

Figure 4:
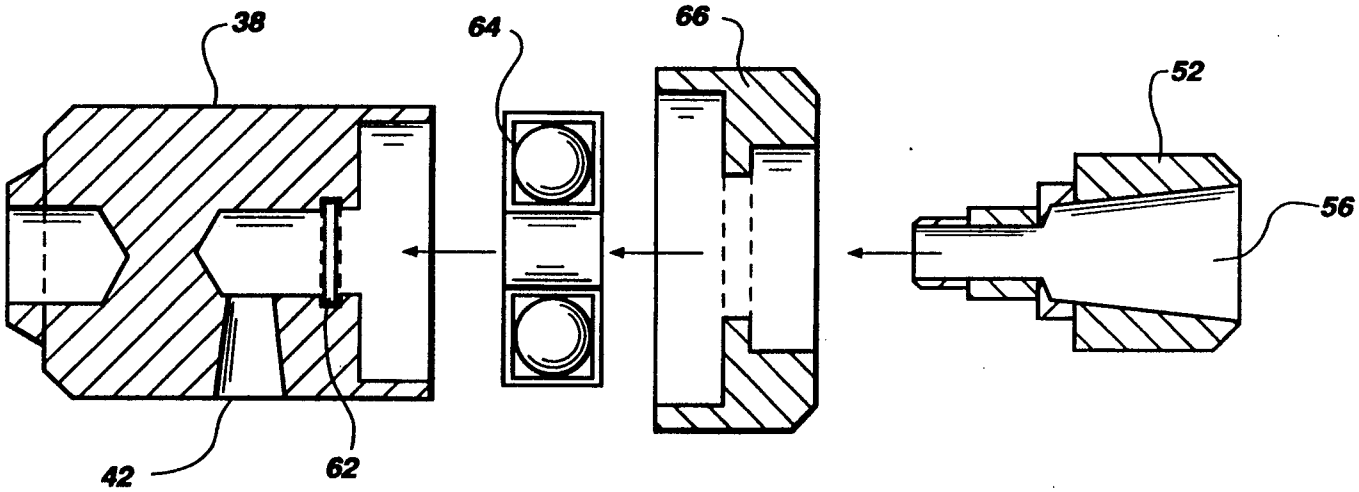
FIG. 4 illustrates an expanded perspective view of the single port rotating vacuum valve shown in FIG. 3

The end of arm segment 22 has a metal butt plate 31 having an exhaust port 32 connected via a tube 34 to the base 38 of the rotating vacuum valve assembly 36. Heat resistant insulating pad 40 constructed of a fluoro-carbon heat resistant material is mounted between the butt plate 31 and casting flask 28 to forms a vacuum seal with the bottom of the casting flask 28. An exhaust hole (not shown) in the heat pad 40 is in communication with the exhaust port 32 to form an evacuation passage leading to the vacuum port 42 of the rotating valve assembly 36 as shown in FIG. 4.

Figure 2:
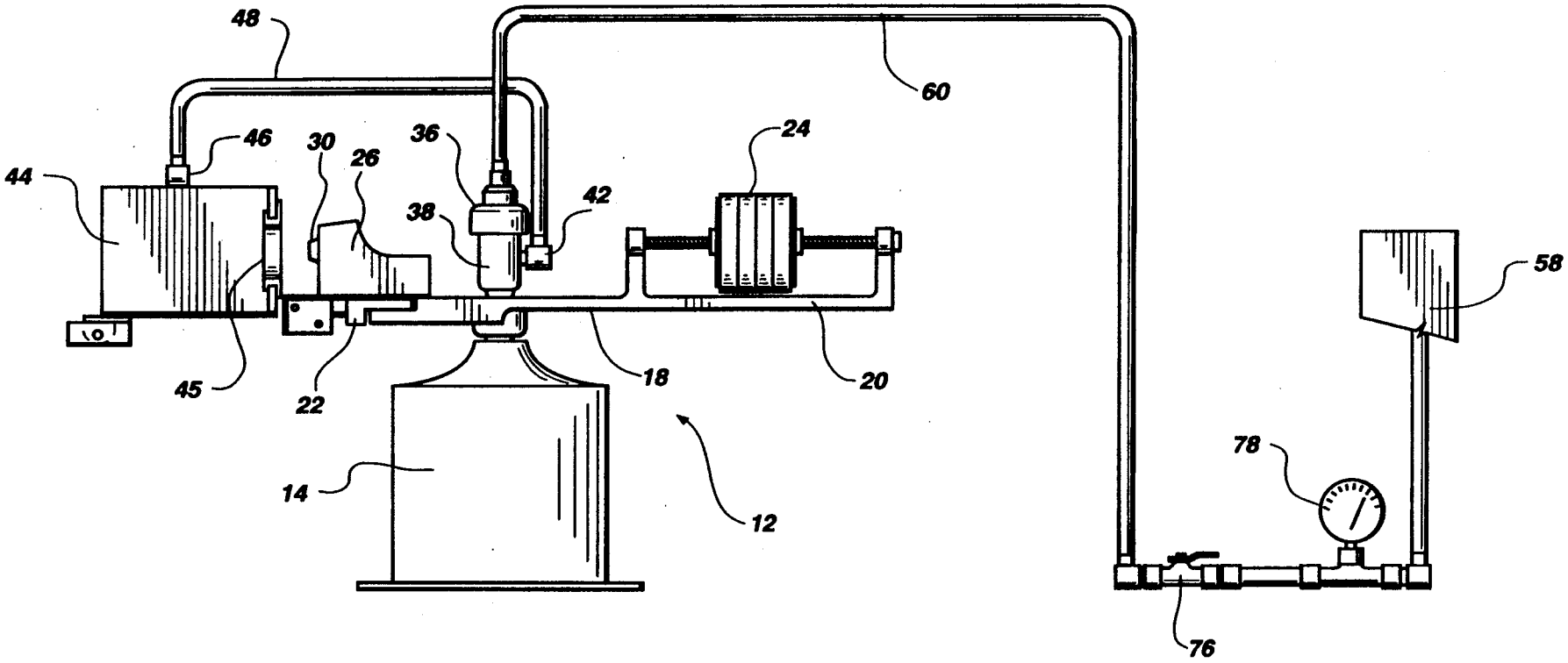
FIG. 2 illustrates another perspective view of a preferred embodiment of the casting apparatus.

FIG. 2 illustrates another preferred embodiment of applicant's invention 12 utilizing a vacuum chamber 44 surrounding the casting flask 28. The casting flask 28 is secured within the vacuum chamber 44 with a collar 45. An evacuation port 46 in the vacuum chamber 44 is connected to the rotating valve assembly 36 via a tube 48. The vacuum chamber 44 is hingedly mounted onto the end of arm segment 22 to pivot and assist in mounting and removing the casting flask 28 secured within the vacuum chamber 44. The casting flask mold opening 29 is in alignment with the pour opening 30 of the casting crucible 26.

Figure 3:
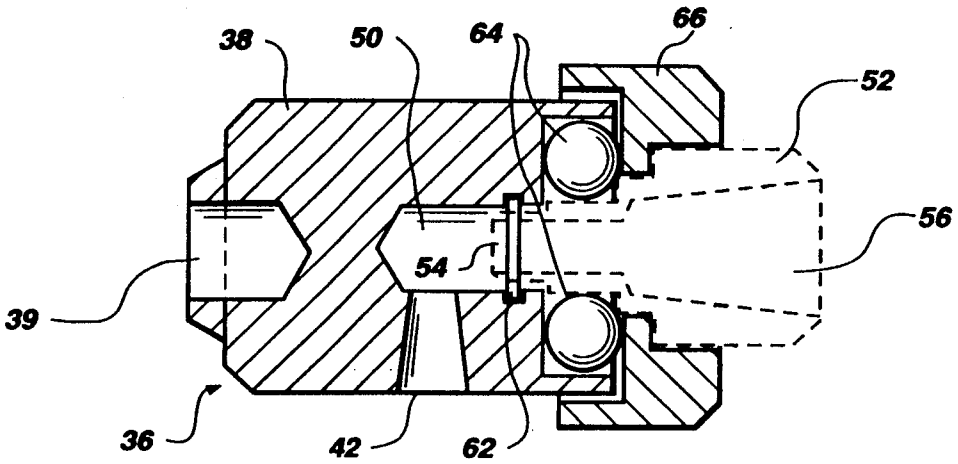
FIG. 3 illustrates a perspective view of an assembled single port rotating vacuum valve.

The rotating valve assembly 36 has its base 38 attached to the shaft 16 to secure the rotating arm 18 thereon via a screw mount 39. The side of the base 38 has a vacuum port 42 to which the tube 48 is attached. The vacuum port 42 leads into a circumferential interior chamber 50 adapted to accommodate a rotating slip joint 52, as shown in FIG. 3. The slip joint 52 is tubular with a hollow interior leading to an interior first opening 54 surrounded by and in communication with the interior chamber 50 of the base 38. The other end of the slip joint 52 has a second exterior opening 56 connected to a vacuum pump system 58 via a second vacuum tube 60. An O-ring 62 is mounted around the slip joint 52 between the base 38 and slip joint 52 to form a rotating vacuum seal therebetween. As the base 38 pivots around the stationary slip joint 52, neither the second tube system 60, nor the primary tube 34 becomes entangled with the stationary vacuum tube 60.

To assist the base 38 in rotating, a ball bearing ring 64 is preferably mounted between the slip joint 52 and the base 38, and secured therebetween with a dust cap 66.

FIG. 4 is an expanded view of the rotating valve assembly 36.

In operation, the wax burned out heated casting flask 28 is placed on the mount 27. The casting crucible 26 is filled with metal, which is then melted with a blowtorch. The vacuum pump system 58 is then turned on and the spring driven motor 14 released forcing and drawing molten metal into the mold 29.

The tubing 60 is made of a rigid non-collapsible material, such as Teflon ® that is also resistant to heat generated during casting. The tubing 34, 48 is made of a flexible non-collapsible material, such as vinyl.

A ball valve 76 between the vacuum pump 58 and the rotating valve assembly 36 may be included to build-up the desired vacuum before applying it to the casting flask 28. In this manner, the vacuum may be suddenly removed to assist in drawing in metal within the casting flask 28. A pressure gauge 78 may also be included to assist in applying the desired pressures.

Although this specification has made reference to the illustrated embodiments, it is not intended to restrict the scope of the appended claims. The claims themselves recite those features deemed essential to the invention.

I claim:

1. An ambient air combination centrifugal force and aligned directional vacuum assist casting method to fill a pre-heated casting flask at a desired casting temperature having a mold with a pour opening in communication with the pour opening of a casting crucible filled with molten metal and ceramics, comprising:

centrifugally spinning with an arm centrifuge apparatus the heated casting flask and casting crucible with their pour openings aligned such that the resulting centrifugal forces empty the contents of the casting crucible into the casting flask; while simultaneously applying a vacuum in the direction of the centrifugal forces to the casting flask in a manner to evacuate trapped gases and unburned hydrocarbons from the mold and assist in drawing in the molten metal and ceramics into the mold; said centrifuge apparatus having:

a. a drive motor having a shaft, b. a rotating arm attached to the shaft of the motor to form two rotating arm segments spun by the action of the motor, said first arm segment having a mount proximate its end positioned next to a casting crucible with an open top and pour spout, and a second arm with a movable counterbalancing weight attached to counterbalance the apparatus during rotation by the drive motor, c. a casting flask with a mold having a pour opening removably mounted onto the mount with its pour opening in alignment with the casting crucible pour spout to be filled by molten metals and ceramics in the casting crucible, when centrifugally rotated, d. a butt plate with a heat insulation pad seal associated with the mount structured to form a vacuum seal with the bottom of the casting flask when placed on the mount, said butt plate and heat insulation pad seal having an exhaust port sealed in communication with the bottom of the casting flask, and e. a rotating vacuum valve attached to the rotating arm between the arm segments, having i. a rotating body having walls defining an internal vacuum reservoir in communication with a receiving port in the walls of the rotating body, ii. a tube connecting the exhaust port of the butt plate with the receiving port of the rotating body to form an evacuation path leading to the vacuum reservoir, iii. a stationary dust cap rotatably sealed onto the rotating body having an evacuation port in communication with the vacuum reservoir and a vacuum source to selectively apply the desired vacuum to the bottom of the casting flask during centrifugal rotation of the casting flask to remove trapped gases and air born materials from the mold, while assisting in drawing molten metal and ceramics into said mold.

2. An ambient air combination centrifugal force and aligned directional vacuum assist casting method according to claim 1, including melting the molten metals and ceramics with a flux to prevent oxidation, and tarnishing of the metal and ceramics by trapped gases.

3. An ambient air combination centrifugal force and aligned directional vacuum assist casting apparatus to fill centrifugally with molten metal and ceramics a preheated casting flask at a desired casting temperature having a mold comprising:

a. a drive motor having a shaft, b. a rotating arm attached to the shaft of the motor to form two rotating arm segments spun by the action of the motor, said first arm segment having a mount proximate its end positioned next to a casting crucible with an open top and pour spout, and a second arm with a movable counterbalancing weight attached to counterbalance the apparatus during rotation by the drive motor, c. a casting flask with a mold having a pour opening removably mounted onto the mount with its pour opening in alignment with the casting crucible pour spout to be filled by molten metals and ceramics in the casting crucible, when centrifugally rotated, d. a butt plate with a heat insulation pad seal associated with the mount structured to form a vacuum seal with the bottom of the casting flask when placed on the mount, said butt plate and heat insulation pad seal having an exhaust port sealed in communication with the bottom of the casting flask, and e. a rotating vacuum valve attached to the rotating arm between the arm segments, having i. a rotating body having walls defining an internal vacuum reservoir in communication with a receiving port in the walls of the rotating body, ii. a tube connecting the exhaust port of the butt plate with the receiving port of the rotating body to form an evacuation path leading to the vacuum reservoir, iii. a stationary dust cap rotatably sealed onto the rotating body having an evacuation port in communication with the vacuum reservoir and a vacuum source to selectively apply the desired vacuum to the bottom of the casting flask during centrifugal rotation of the casting flask to remove trapped gases and unburned hydrocarbon materials from the mold, while assisting in drawing molten metal and ceramics into said mold.

4. An ambient air combination centrifugal force and aligned directional vacuum assist casting apparatus according to claim 3, wherein the vacuum source comprises a vacuum pump system.

5. An ambient air combination centrifugal force and aligned directional vacuum assist casting kit for a centrifugal casting apparatus having: a) a drive motor having a shaft, b) a rotating arm attached to the shaft of the motor to form two rotating arm segments spun by the action of the motor, said first arm segment having a mount proximate its end positioned next to a casting crucible with an open top and pour spout, and a second arm with a movable counterbalancing weight attached to counterbalance the apparatus during rotation by the drive motor, c) a casting flask which can be pre-heated to a desired casting temperature with a mold having a pour opening removably mounted onto the mount with its pour opening positioned to be filled by the molten metals and ceramics in the casting crucible, when centrifugally rotated, comprising:

i. a butt plate with a heat insulation pad seal associated with the mount structured to form a vacuum seal with the bottom of the casting flask when placed on the mount, said butt plate and heat insulation pad seal having an exhaust port sealed in communication with the bottom of the casting flask, and ii. a vacuum source to apply the desired vacuum, and iii. a rotating vacuum valve attached to the rotating arm between the arm segments, having a. a rotating body having walls defining a receiving port and an internal vacuum reservoir in communication with the receiving port, b. a tube connecting the exhaust port of the butt plate with the receiving port of the rotating body to form an evacuation path leading to the vacuum reservoir, c. a stationary dust cap rotatably sealed onto the rotating body having an evacuation port in communication with the vacuum source to selectively apply the desired vacuum to the bottom of the casting flask during centrifugal rotation of the casting flask to remove trapped gases and unburned hydrocarbon materials from the mold, and assist in drawing molten metal and ceramics into said mold.

6. An ambient air combination centrifugal force and aligned directional vacuum assist casting kit for a centrifugal casting apparatus having: a) a drive motor having a shaft, b) a rotating arm attached to the shaft of the motor to form two rotating arm segments spun by the action of the motor, said first arm segment having a mount proximate its end positioned next to a casting crucible with an open top and pour spout, and a second arm with a movable counterbalancing weight attached to counterbalance the apparatus during rotation by the drive motor, c) a casting flask which can be pre-heated to a desired casting temperature with a mold having a pour opening removably mounted onto the mount with its pour opening positioned to be filled by the molten metals and ceramics in the casting crucible, when centrifugally rotated, comprising:

i. a vacuum chamber associated with the mount with walls structured to accommodate a removable casting flask secured therein with a collar to form a vacuum seal surrounding the opening of the mold which is held in alignment with the pour spout of the casting crucible, said vacuum chamber having an exhaust port in its walls, ii. a vacuum source to apply the desired vacuum, and iii. a rotating vacuum valve attached to the rotating arm between the arm segments, having a. a rotating body having walls defining a receiving port and an internal vacuum reservoir in communication with the receiving port, b. a tube connecting the exhaust port of the butt plate with the receiving port of the rotating body to form an evacuation path leading to the vacuum reservoir, c. a stationary dust cap rotatably mounted onto the rotating body having an evacuation port in communication with the vacuum source to selectively apply the desired vacuum to the vacuum chamber during centrifugal rotation of the casting flask to remove trapped gases and unburned hydrocarbon materials from the mold, and assist in drawing molten metal and ceramics into said mold.

* * * * *